US009097260B2

(12) United States Patent
Chou et al.

(10) Patent No.: US 9,097,260 B2
(45) Date of Patent: Aug. 4, 2015

(54) FAN BEARING RETAINING STRUCTURE

(75) Inventors: Chu-Hsien Chou, New Taipei (TW); Shao-Jun Hong, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 602 days.

(21) Appl. No.: 13/472,160

(22) Filed: May 15, 2012

(65) Prior Publication Data

US 2013/0309086 A1 Nov. 21, 2013

(51) Int. Cl.

| | |
|---|---|
| ***F04D 29/04*** | (2006.01) |
| ***F04D 29/046*** | (2006.01) |
| ***F04D 29/056*** | (2006.01) |
| ***F04D 25/06*** | (2006.01) |

(52) U.S. Cl.

CPC ..... *F04D 29/04* (2013.01); *F04D 25/062* (2013.01); *F04D 25/0613* (2013.01); *F04D 29/046* (2013.01); *F04D 29/0462* (2013.01); *F04D 29/056* (2013.01); *F04D 29/0563* (2013.01)

(58) Field of Classification Search

CPC . F04D 25/0613; F04D 25/062; F04D 29/046; F04D 29/0462; F04D 29/056; F04D 29/0563

USPC ..... 416/174, 204 R, 209; 415/229, 170.1

See application file for complete search history.

(56) References Cited

U.S. PATENT DOCUMENTS

| | | | | |
|---|---|---|---|---|
| 4,488,825 | A * | 12/1984 | Cavagnero et al. | 384/152 |
| 4,682,065 | A * | 7/1987 | English et al. | 310/90 |
| 5,264,748 | A * | 11/1993 | Ootsuka et al. | 310/90 |
| 5,343,104 | A * | 8/1994 | Takahashi et al. | 310/90 |
| 6,654,213 | B2 * | 11/2003 | Horng et al. | 361/23 |
| 2009/0256441 | A1 * | 10/2009 | Horng et al. | 310/90 |
| 2010/0102660 | A1 * | 4/2010 | Lu | 310/89 |
| 2010/0207469 | A1 * | 8/2010 | Yuan et al. | 310/90 |
| 2012/0194009 | A1 * | 8/2012 | Horng | 310/43 |

* cited by examiner

*Primary Examiner* — Edward Look
*Assistant Examiner* — Jesse Prager
(74) *Attorney, Agent, or Firm* — C. G. Mersereau; Nikolai & Mersereau, P.A.

(57) ABSTRACT

A fan bearing retaining structure includes a base and a ring member. The base has a bearing cup projected from one side thereof, and the bearing cup internally defines an axial bore for receiving a bearing therein. The ring member is fitted around an outer side of the bearing cup and defines an opening, such that an inner side of the opening tightly contacts with the outer side of the bearing cup to apply a radially inward compression toward the axial bore. With these arrangements, a portion of the axial bore corresponding to the ring member fitted around the bearing cup has a reduced inner diameter to thereby effectively retain the bearing in the bearing cup, enabling a fan to be manufactured at reduced cost.

9 Claims, 9 Drawing Sheets

FAN BEARING RETAINING STRUCTURE

FIELD OF THE INVENTION

The present invention relates to a bearing retaining structure, and more particularly to a fan bearing retaining structure that effectively retains a bearing in a bearing cup at reduced manufacturing cost to avoid the problem of a loose bearing in the bearing cup of a fan.

BACKGROUND OF THE INVENTION

Many devices, such as fans, use a motor to achieve the purpose of transmission. Therefore, the quality of a motor plays a very important role in the performance of a motor-driven device. A motor failing to work stably would no doubt adversely affect the whole operation of the device. Among others, the bearing is one of the most important factors that have influence on the quality of a motor.

Conventionally, a fan is formed by injection molding a plastic material. In the manufacturing process of the fan, a central tube of the fan is integrally injection molded along with a bearing, so that the bearing is fixedly held in the central tube to allow stable operation of a motor of the fan. While the bearing can be held in the central tube when the fan is injection molded with a plastic material, the bearing is not held in the central tube in a desired condition good for stable motor operation. This is because the plastic material is subject to thermal expansion and cold contraction, and it is therefore difficult to control correct fitting tightness and required range of fitting allowance between the bearing and the central tube in the process of manufacturing the bearing and the central tube. That is, it is uneasy to achieve proper fit between the bearing and the central tube. For example, in the event the bearing is too tightly fitted in the central tube, it would result in the formation of shrinkage holes on the bearing. On the other hand, in the event the bearing is too loosely fitted in the central tube, it would not be able to effectively hold the bearing in place in the central tube and result in low fitting accuracy and poor fitting allowance. Thus, the conventional way of forming a fan through plastic injection-molding fails to effectively hold the bearing in place in the central tube, and it is uneasy to control the fitting accuracy between the bearing and the central tube in the manufacturing process. These drawbacks in turn cause unstable operation of the fan motor.

In another type of fan structure, the central tube is made of a metal material and is integrally formed with the frame of the fan through insert molding. The metal central tube is processed by machining and therefore has relatively high process precision, which enables proper fitting of the bearing in the metal central tube to overcome the drawbacks in the plastic injection-molded fan. However, the metal central tube involves relatively complicated structure and machining procedures. For example, the metal central tube must be additionally machined to provide a shoulder portion therein for supporting the bearing in the central tube. Therefore, the use of the metal central tube inevitably increases the overall manufacturing cost of the fan.

In brief, the prior art fan bearing retaining structures have the following disadvantages: (1) having low fitting accuracy and poor fitting allowance between the bearing and the plastic central tube; (2) failing to effectively hold the bearing in place to thereby cause vibration of motor; (3) requiring increased cost for manufacturing a metal central tube for stably holding a bearing therein; and (4) involving complicated manufacturing processes and accordingly increased labor and time.

It is therefore tried by the inventor to develop an improved fan bearing retaining structure to overcome the disadvantages in the prior art.

SUMMARY OF THE INVENTION

A primary object of the present invention is to provide a fan bearing retaining structure for effectively retaining a bearing in a bearing cup of a fan.

Another object of the present invention is to provide a fan bearing retaining structure that enables improved fitting accuracy and fitting allowance between a bearing and a bearing cup.

A further object of the present invention is to provide a fan bearing retaining structure that enables reduced assembling time and labor and accordingly reduced manufacturing cost of a fan.

To achieve the above and other objects, the fan bearing retaining structure according to the present invention includes a base and a ring member. The base has a bearing cup projected from one side thereof, and the bearing cup internally defines an axial bore for receiving a bearing therein. The ring member is fitted around an outer side of the bearing cup and defines an opening, such that an inner side of the opening tightly contacts with the outer side of the bearing cup to apply a radially inward compression on the axial bore. With these arrangements, a portion of the axial bore corresponding to the ring member fitted around the bearing cup has a reduced inner diameter to thereby effectively retain the bearing in the bearing cup, enabling a fan to be manufactured at lowered cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
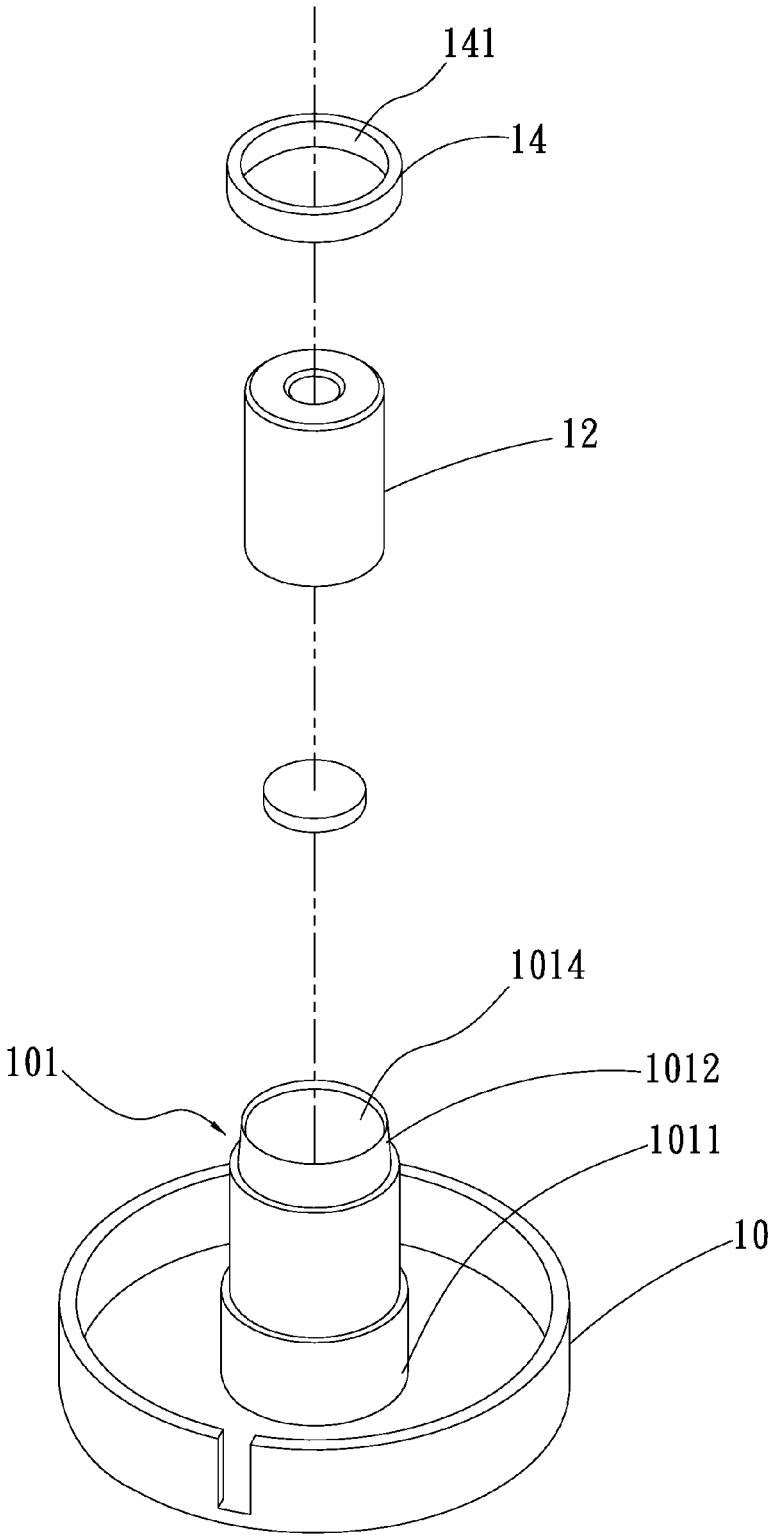
FIG. 1 is an exploded perspective view of a fan bearing retaining structure according to a first preferred embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 2A:
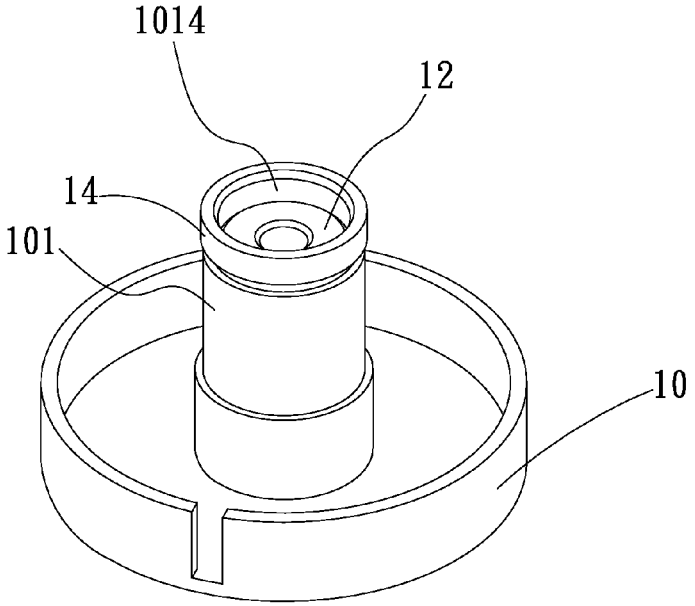
FIG. 2A is an assembled view of FIG. 1.
Figure 2B:
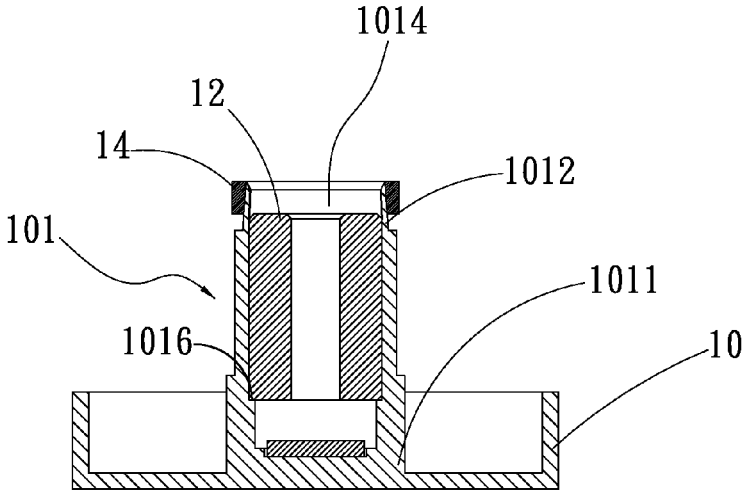
FIG. 2B is a sectional view of FIG. 2A.

Please refer to FIGS. 1 and 2A that are exploded and assembled perspective views, respectively, of a fan bearing retaining structure according to a first preferred embodiment of the present invention; and to FIG. 2B that is a sectional view of FIG. 2A. As shown, the fan bearing retaining structure in the first preferred embodiment includes a base 10 and a ring member 14. The base 10 includes a bearing cup 101 projected from one side of the base 10. The bearing cup 101 internally defines an axial bore 1014 and a shoulder portion 1016. The shoulder portion 1016 radially inward protrudes from an inner side of the bearing cup 101 toward a center of the axial bore 1014. A bearing 12 is received in the axial bore 1014 and supported on the shoulder portion 1016.

The bearing cup 101 has a first end 1011 fixedly connected to a center of the base 10, and a second end 1012 formed by axially extending from the first end 1011. The ring member 14 can be made of a metal material, a plastic material or a polymeric material, and is externally fitted around the bearing cup 101. The ring member 14 defines an opening 141 therein, such that the ring member 14 is fitted around the bearing cup 101 with an inner side of the opening 141 in contact with an outer side of the bearing cup 101 to thereby inward compress the axial bore 1014 of the bearing cup 101. That is, when the ring member 14 is externally fitted around the second end 1012 of the bearing cup 101, the opening 141 of the ring member 14 radially inward compresses or pushes against the second end 1012 to thereby elastically deform the second end 1012 and reduce the diameter of the axial bore 1014 at the second end 1012, so that the bearing 12 is retained in the bearing cup 101 behind the second end 1012.

Figure 3A:
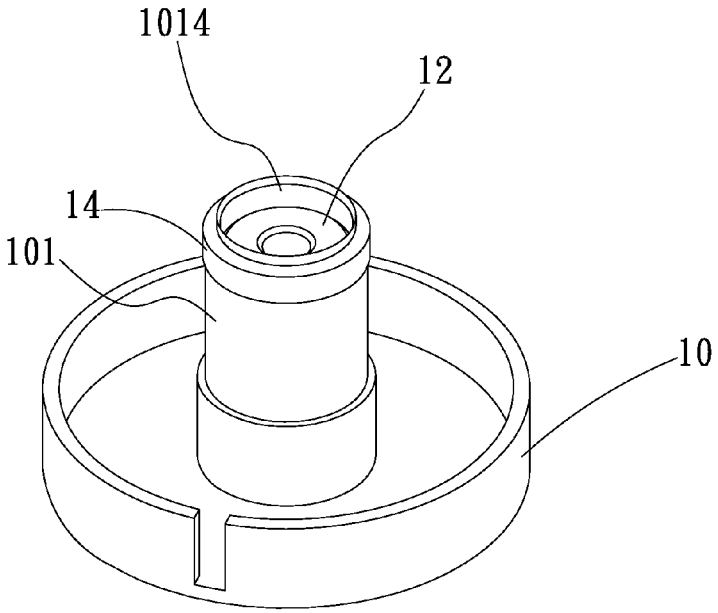
FIG. 3A is another assembled perspective view of the fan bearing retaining structure according to the first preferred embodiment of the present invention.
Figure 3B:
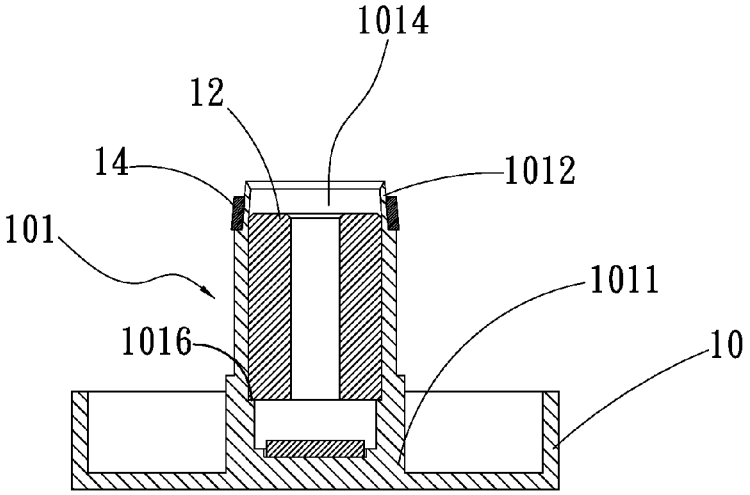
FIG. 3B is a sectional view of FIG. 3A.

In practical implementation of the present invention, a user may adjust the depth by which the ring member 14 fitted around the bearing cup 101 is to be axially pushed along onto the second end 1012 according to the required tightness in which the bearing 12 is to be retained in the bearing cup 101. As can be seen in FIGS. 3A and 3B, the ring member 14 is axially pushed along onto the second end 1012 of the bearing cup 101 by a distance deeper than that shown in FIGS. 2A and 2B, such that the bearing 12 in the bearing cup 101 is subjected to an increased tightness of compression.

Figure 4A:
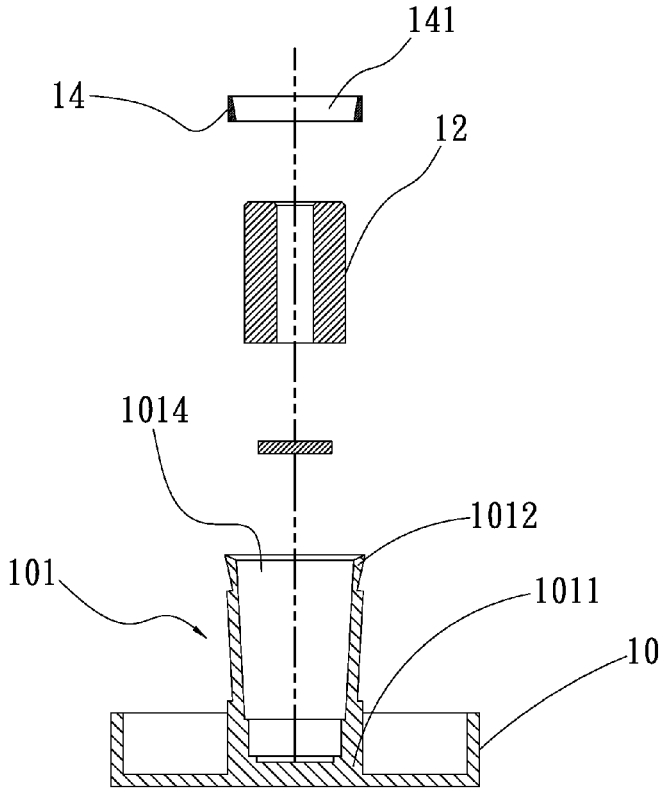
FIG. 4A is an exploded sectional view of a variant of the fan bearing retaining structure according to the first preferred embodiment of the present invention.
Figure 4B:
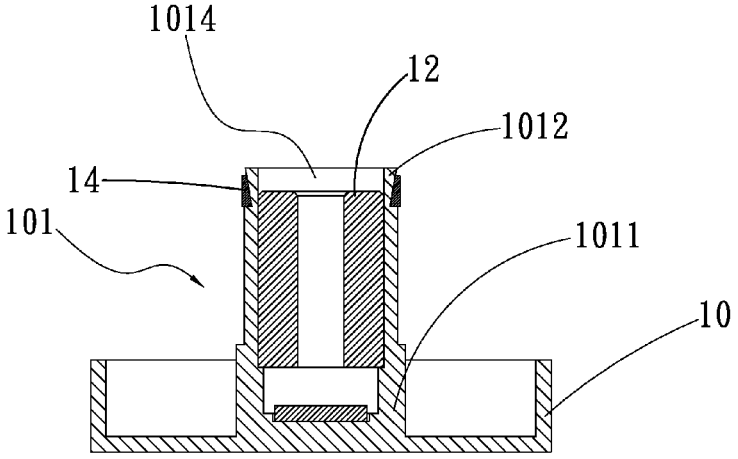
FIG. 4B is an assembled view of FIG. 4A.

In the first preferred embodiment, with the ring member 14 fitted around the second end 1012 of the bearing cup 101, the first end 1011 has an inner diameter larger than that at the second end 1012 and the bearing cup 101 has a substantially forward tapered shape. In practical implementation of the present invention, the user may change the shape of the bearing cup 101 in advance according to required fitting accuracy and fitting allowance between the bearing 12 and the bearing cup 101. For example, in a variant of the first embodiment as shown in FIGS. 4A and 4B, the second end 1012 of the bearing cup 101 before being fitted with the ring member 14 has an outer side in a substantially rearward tapered shape, and the first end 1011 of the bearing cup 101 has an inner diameter smaller than that of the second end 1012. When the ring member 14 is externally fitted around the second end 1012 of the bearing cup 101, the opening 141 of the ring member 14 applies a radially inward compression or pressure to elastically deform the second end 1012 and accordingly reduce the inner diameter of the axial bore 1014 at the second end 1012, so that the bearing 12 is retained in the bearing cup 101 behind the second end 1012.

Therefore, by externally tightly fitting the ring member 14 around the bearing cup 101 projected from the base 10, the present invention not only effectively prevents the bearing 12 from loosening from the bearing cup 101 to thereby achieve the effect of retaining the bearing 12 in the bearing cup 101, but also enables improved fitting accuracy and fitting allowance between the bearing 12 and the bearing cup 101.

Further, with the ring member 14 externally tightly fitted around the bearing cup 101 during the manufacturing process of a fan, time needed for assembling the fan can be reduced to thereby lower the manufacturing cost of the fan.

Figure 5:
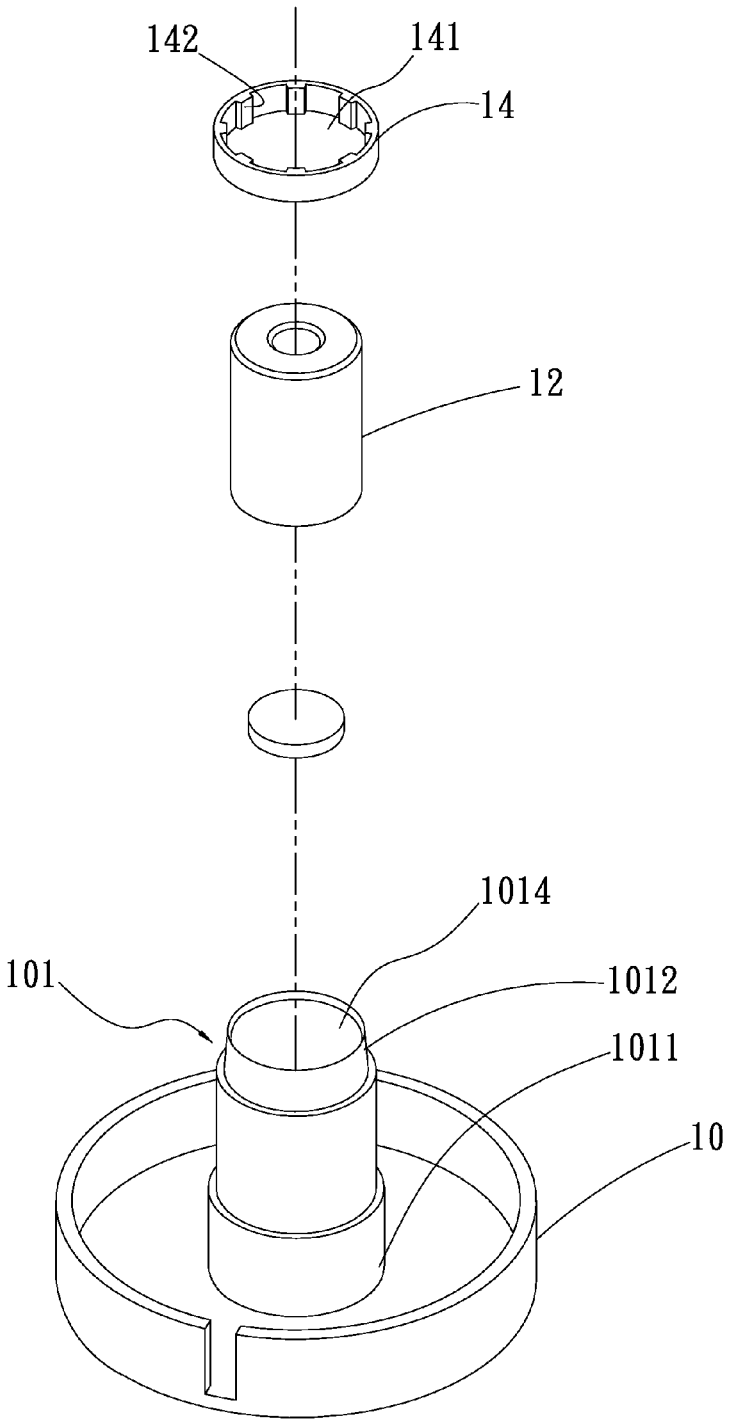
FIG. 5 is an exploded perspective view of a fan bearing retaining structure according to a second preferred embodiment of the present invention.
Figure 6:
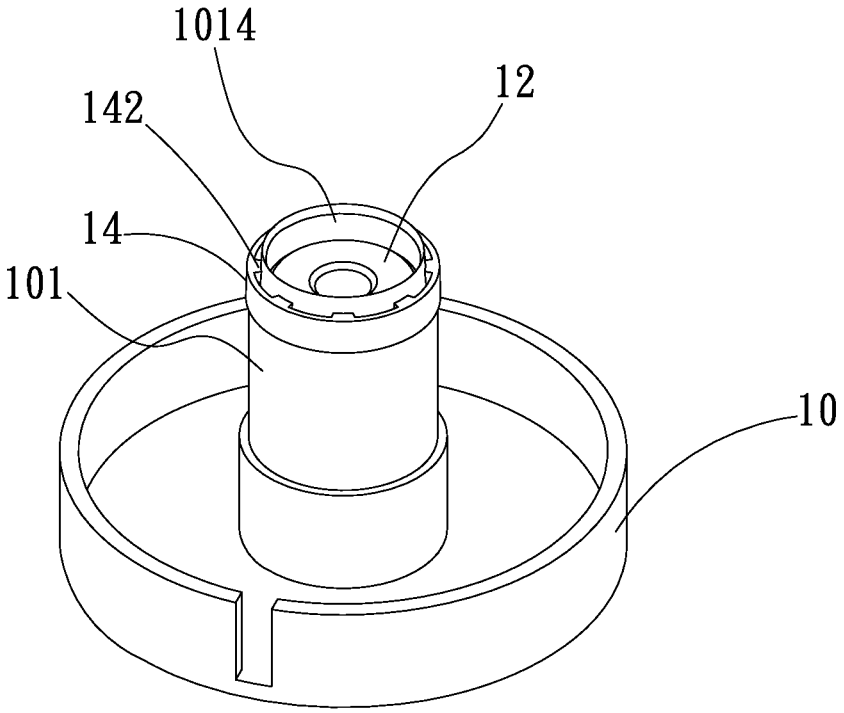
FIG. 6 is an assembled view of FIG. 5.

FIGS. 5 and 6 are exploded and assembled perspective views, respectively, of a fan bearing retaining structure according to a second preferred embodiment of the present invention. As shown, the second preferred embodiment is generally structurally similar to the first preferred embodiment, except for a plurality of protrusions 142 formed on the inner side of the opening 141 of the ring member 14. The protrusions 142 are radially inward protruded from the inner side of the opening 141 toward a center of the opening 141 for bearing on the outer side of the bearing cup 101 and applying a radially inward compression on the axial bore 1014 of the bearing cup 101. That is, the protrusions 142 radially inward compress or press against and accordingly elastically deform the second end 1012 of the bearing cup 101 to reduce the inner diameter of the axial bore 1014 at the second end 1012. In this manner, it is also possible to achieve the effects of retaining the bearing 12 in the bearing cup 101 and improving the fitting accuracy and fitting allowance between the bearing 12 and the bearing cup 101.

In the illustrated second preferred embodiment, the protrusions 142 are equally spaced along the inner side of the opening 141. However, in practical implementation of the present invention, the protrusions 142 are not necessarily equally spaced but can be irregularly spaced along the inner side of the opening 141.

Figure 7:
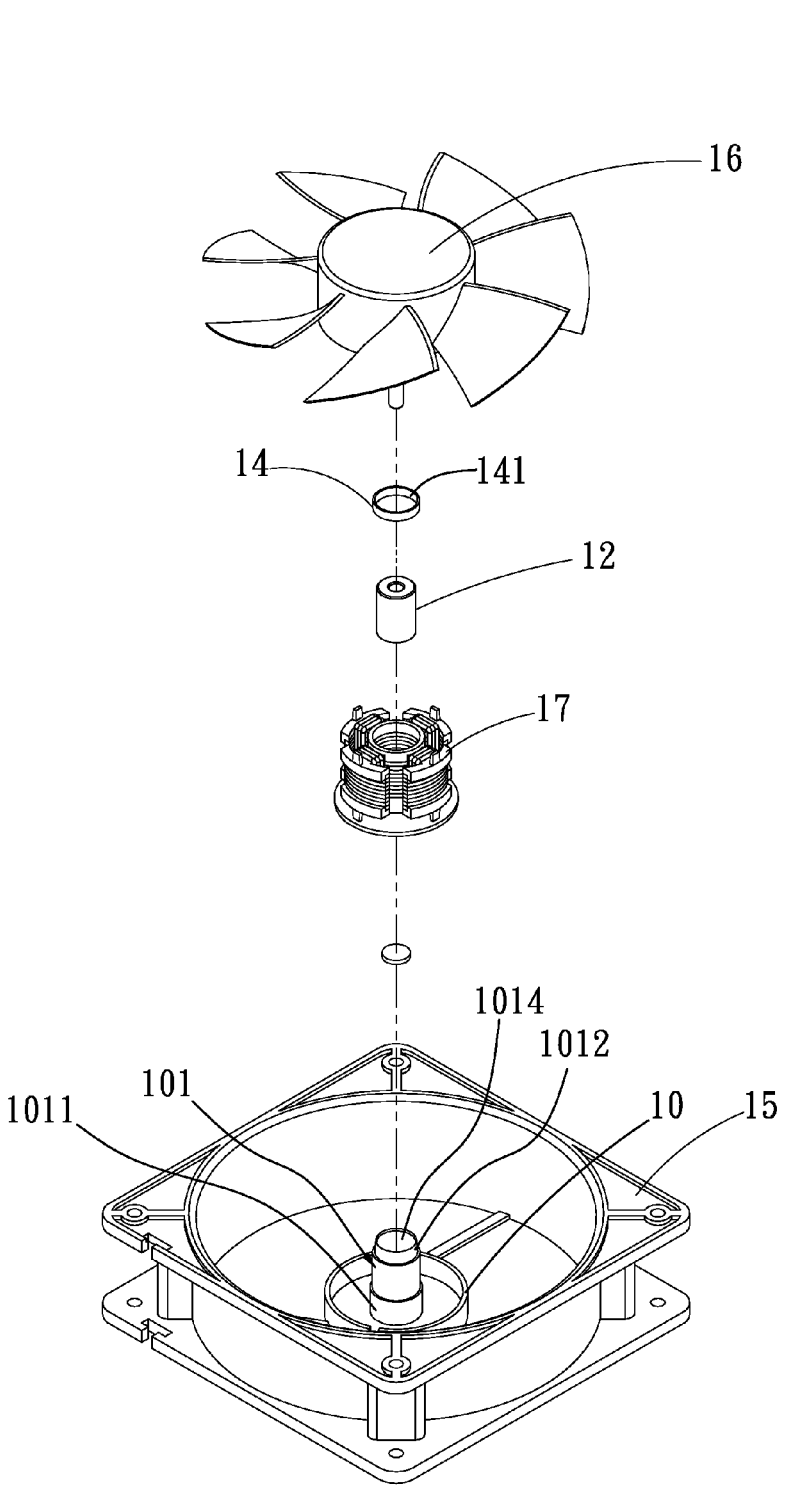
FIG. 7 is an exploded perspective view of a fan with bearing retaining structure according to a third preferred embodiment of the present invention.
Figure 8A:
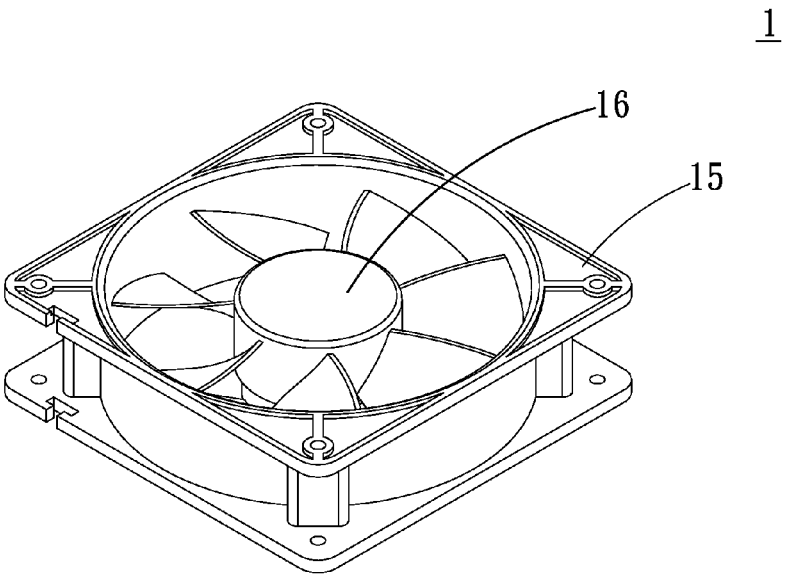
FIG. 8A is an assembled view of FIG. 7.
Figure 8B:
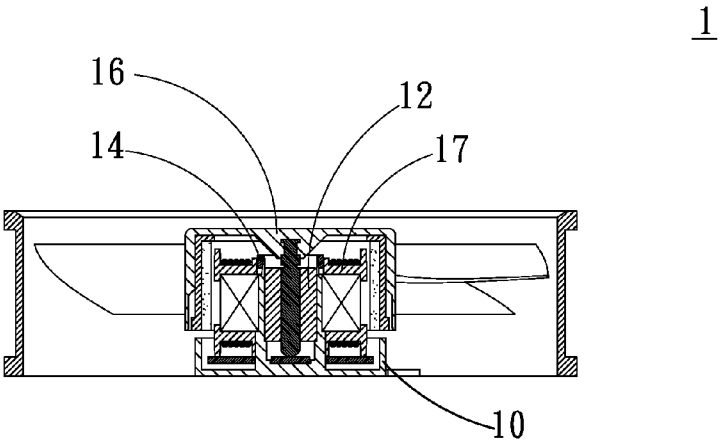
FIG. 8B is a sectional view of FIG. 8A.

Please refer to FIGS. 7 and 8A that are exploded and assembled perspective views, respectively, of a fan with bearing retaining structure according to a third preferred embodiment of the present invention, and to FIG. 8B that is a sectional view of FIG. 8A. The fan is generally denoted by reference numeral 1 and includes a frame 15, a rotor 16, and a stator 17; and the bearing retaining structure is similar to that described in the previous embodiments of the present invention. The base 10 is arranged in the frame 15 for the rotor 16 to rotatably connect thereto. The stator 17 is fitted around the outer side of the bearing cup 101 to adjoin the ring member 14 externally fitted around the second end 1012 of the bearing cup 101. With the ring member 14 fitted around the second end 1012 of the bearing cup 101, the second end 1012 is subjected to the radially inward compression or push from the ring member 14 and is elastically deformed to reduce the inner diameter of axial bore 1014 at the second end 1012. Therefore, when the rotor 16 rotates, the bearing 12 can be stably retained in the bearing cup 101 behind the second end 1012, allowing stable rotation of the rotor 16 relative to the bearing 12 and accordingly, allowing stable operation of the fan 1.

Figure 9:
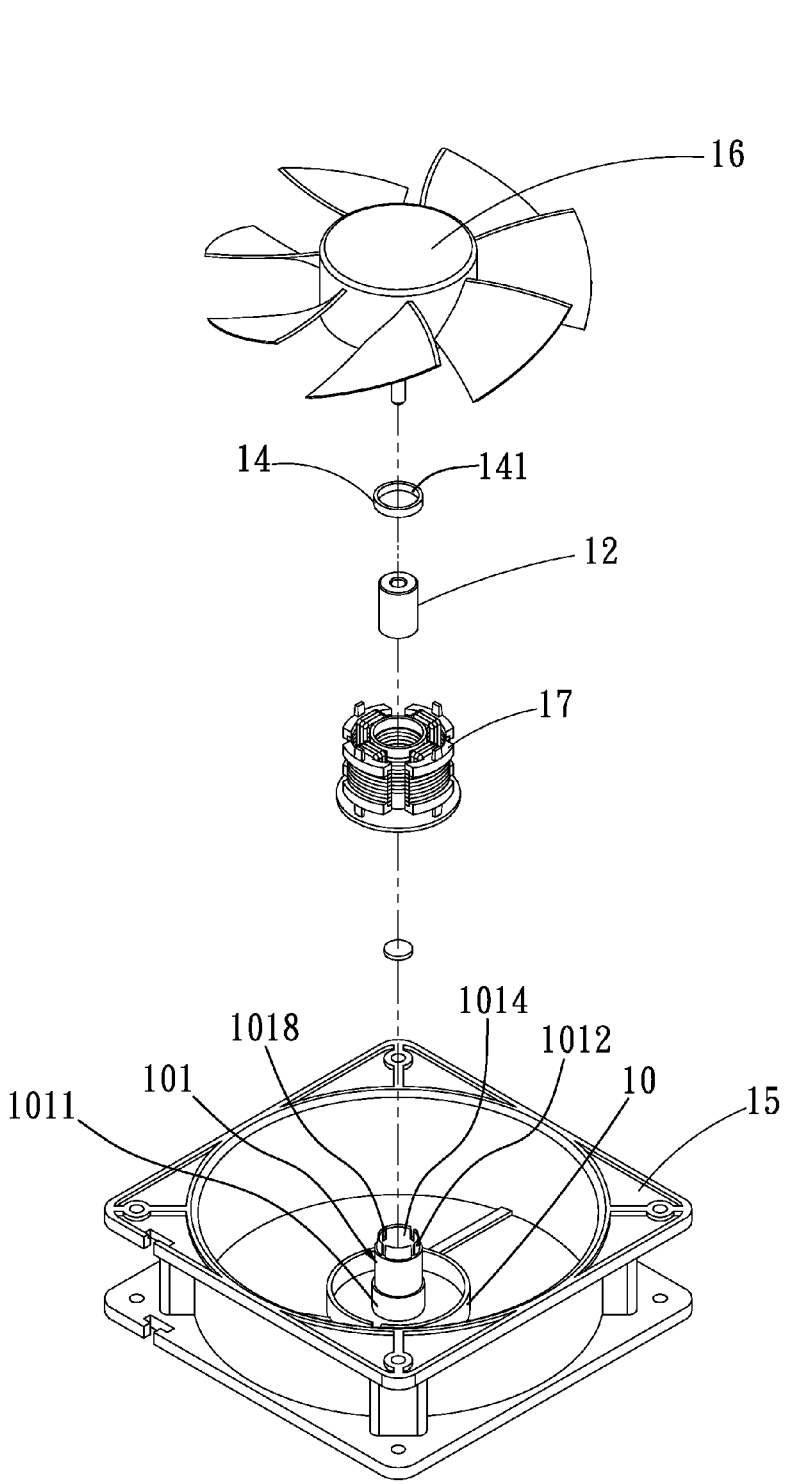
FIG. 9 is an exploded perspective view of a variant of the fan with bearing retaining structure according to the third preferred embodiment of the present invention.

FIG. 9 is an exploded perspective view of a variant of the third preferred embodiment of the present invention. As shown, this variant is different from the third preferred embodiment mainly in that the bearing cup 101 is provided on a circumferential edge of the second end 1012 with at least one axially extended cut 1018, so that the second end 1012 acts like a claw and is provided with a certain degree of elasticity to facilitate convenient and tight fitting of the ring member 14 around the second end 1012.

In conclusion, the fan bearing retaining structure according to the present invention is superior to the prior art due to the following advantages: (1) capable of retaining the bearing in the bearing cup and effectively improving the fitting accuracy and fitting allowance between the bearing and the bearing cup; (2) enabling reduced manufacturing cost; and (3) enabling reduced assembling time and labor.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan bearing retaining structure, comprising:

a base having a bearing cup projected from one side thereof, and the bearing cup internally defining an axial bore for receiving a bearing therein; and a ring member defining an opening therein, and being fitted around the bearing cup with an inner side of the opening tightly contacting with an outer side of the bearing cup to apply and keep a radially inward compression to the axial bore;

wherein the bearing cup has a first end fixedly connected to a center of the base and a second end formed by axially and obliquely outward extending from the center of the base; and the ring member being fitted around the bearing cup at the second end such that the second end can keep a radially inward compression to the axial bore; and wherein the first end of the bearing cup has an inner diameter smaller than that of the second end.

2. The fan bearing retaining structure as claimed in claim 1, wherein the bearing cup is substantially forward tapered in shape.

3. The fan bearing retaining structure as claimed in claim 1, wherein the ring member further includes a plurality of protrusions radially inward extended from the inner side of the opening toward a center of the opening for tightly pressing against the outer side of the bearing cup to apply the radially inward compression toward the axial bore.

4. The fan bearing retaining structure as claimed in claim 1, wherein the ring member is made of a material selected from the group consisting of metal materials, plastic materials, and polymeric materials.

5. The fan bearing retaining structure as claimed in claim 1, wherein the first end of the bearing cup has an inner diameter larger than that of the second end.

6. The fan bearing retaining structure as claimed in claim 1, wherein the fan bearing retaining structure is applied to a fan that includes a frame, a rotor and a stator; the base being arranged in the frame with the rotor rotatably connected thereto; and the stator being fitted around the outer side of the bearing cup to adjoin the ring member.

7. The fan bearing retaining structure as claimed in claim 3, wherein the protrusions are equally spaced along the inner side of the opening of the ring member.

8. The fan bearing retaining structure as claimed in claim 3, wherein the protrusions are irregularly spaced along the inner side of the opening of the ring member.

9. The fan bearing retaining structure as claimed in claim 1, wherein a circumferential edge of the second end of the bearing cup is provided with at least one axially cut to facilitate convenient and tight fitting of the ring member around the second end of the bearing cup.

* * * * *